US011286927B2

(12) United States Patent
Eto et al.

(10) Patent No.: US 11,286,927 B2
(45) Date of Patent: Mar. 29, 2022

(54) PUMP DEVICE

(71) Applicant: Nidec Tosok Corporation, Zama (JP)

(72) Inventors: Takamitsu Eto, Zama (JP); Yoshiyuki Kobayashi, Zama (JP); Koji Higuchi, Zama (JP); Yutaka Hashimoto, Zama (JP)

(73) Assignee: NIDEC TOSOK CORPORATION, Kanagawa (JP)

( * ) Notice: Subject to any disclaimer, the term of this patent is extended or adjusted under 35 U.S.C. 154(b) by 253 days.

(21) Appl. No.: 16/488,688

(22) PCT Filed: Mar. 12, 2018

(86) PCT No.: PCT/JP2018/009457

§ 371 (c)(1),
(2) Date: Aug. 26, 2019

(87) PCT Pub. No.: WO2018/173827

PCT Pub. Date: Sep. 27, 2018

(65) Prior Publication Data

US 2021/0207598 A1 Jul. 8, 2021

(30) Foreign Application Priority Data

Mar. 23, 2017 (JP) ..... JP2017-057035

(51) Int. Cl.
*F01C 21/10* (2006.01)
*F04C 2/10* (2006.01)
(Continued)

(52) U.S. Cl.
CPC ..... *F04C 2/102* (2013.01); *F04C 15/008* (2013.01); *F04C 15/06* (2013.01); *F04C 2240/20* (2013.01);
(Continued)

(58) Field of Classification Search
CPC ..... F04C 2/102; F04C 15/008; F04C 2/10; F04C 11/008; F04C 2/18; B60T 13/148; F01C 21/10
See application file for complete search history.

(56) References Cited

U.S. PATENT DOCUMENTS 3,824,047 A * 7/1974 McDermott ..... F04C 2/102 418/171
9,683,567 B2 * 6/2017 Chikaoka ..... H02K 5/1732
(Continued)

FOREIGN PATENT DOCUMENTS

JP 60-006631 Y2 3/1985
JP 06-323266 A 11/1994
(Continued)

OTHER PUBLICATIONS

Official Communication issued in International Patent Application No. PCT/JP2018/009457, dated May 29, 2018.

*Primary Examiner* — Deming Wan
(74) *Attorney, Agent, or Firm* — Keating & Bennett, LLP

(57) ABSTRACT

The pump device includes a motor portion that includes a shaft rotating about a central axis and a pump portion that is driven by a motor portion via the shaft. The pump portion includes a pump rotor that rotates along with the shaft and a pump housing that includes an accommodation portion that accommodates the pump rotor. The pump housing includes a pump body that includes a first bearing portion that supports the shaft and a pump cover with an accommodation portion disposed between the pump cover and the pump body. The pump cover includes a flow path through which oil is discharged and suctioned, and includes a second bearing portion that rotatably supports the shaft and that communicates with the flow path. An end portion of the shaft on one side in the axial direction is disposed at the second bearing portion or inside the flow path.

13 Claims, 7 Drawing Sheets

(51) Int. Cl.

| | |
|---|---|
| ***F04C 15/06*** | (2006.01) |
| ***F04C 11/00*** | (2006.01) |
| ***F04C 15/00*** | (2006.01) |
| ***B60T 13/14*** | (2006.01) |
| ***F04C 2/18*** | (2006.01) |

(52) U.S. Cl.
CPC ..... *F04C 2240/30* (2013.01); *F04C 2240/40* (2013.01); *F04C 2240/50* (2013.01); *F04C 2240/60* (2013.01)

(56) References Cited

U.S. PATENT DOCUMENTS

| | | | | |
|---|---|---|---|---|
| 2001/0026767 | A1 | 10/2001 | Takagi et al. | |
| 2011/0223050 | A1* | 9/2011 | Park | F04C 2/3446 418/104 |
| 2014/0079578 | A1* | 3/2014 | Irie | F04C 11/008 417/423.14 |
| 2016/0363119 | A1 | 12/2016 | Hikichi | |
| 2020/0003210 | A1* | 1/2020 | Kobayashi | F01C 21/10 |

FOREIGN PATENT DOCUMENTS

| | | | |
|---|---|---|---|
| JP | 2010-150964 | A | 7/2010 |
| JP | 2013-163988 | A | 8/2013 |
| JP | 2017-002793 | A | 1/2017 |

* cited by examiner

[Fig. 1]
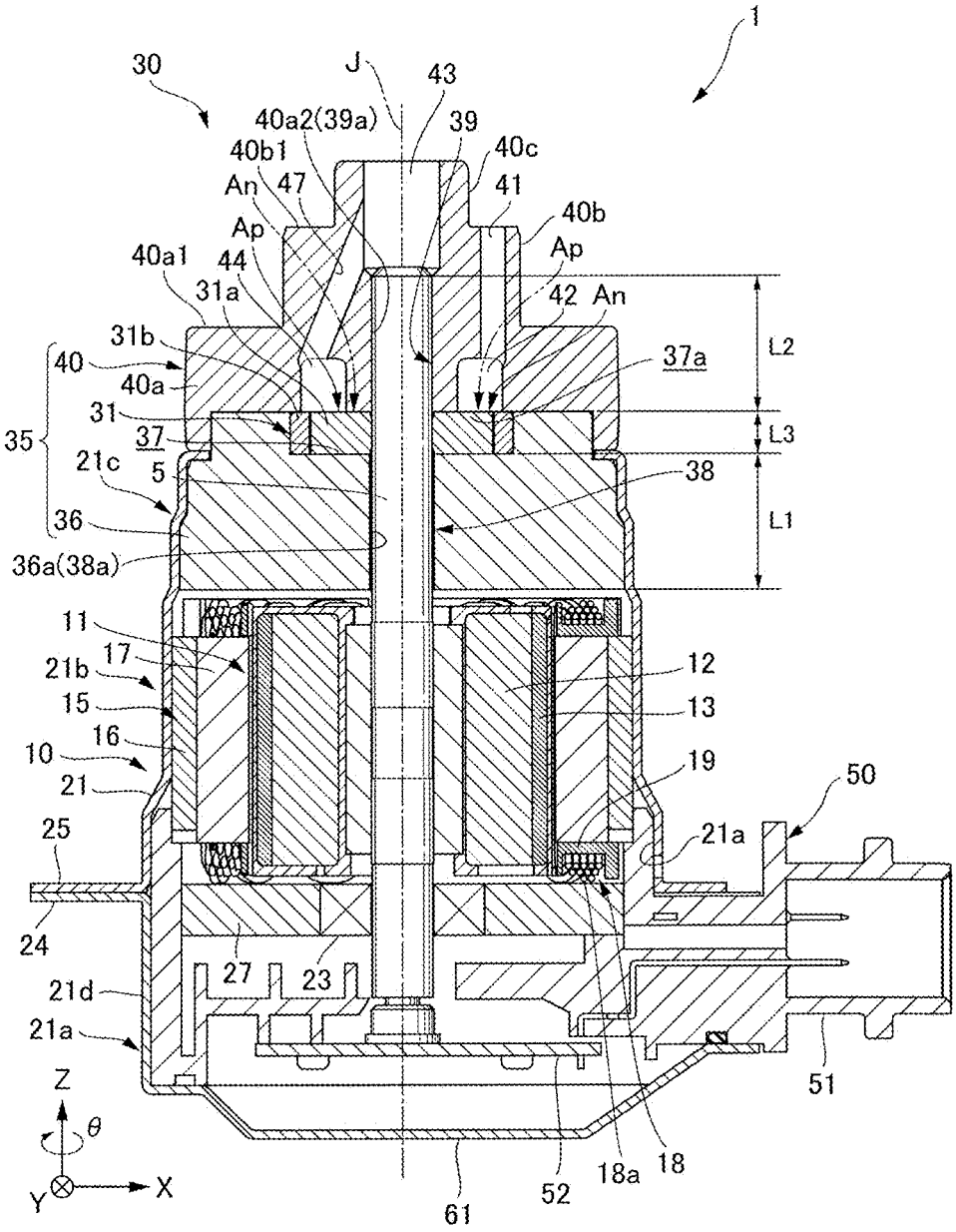

[Fig. 2]
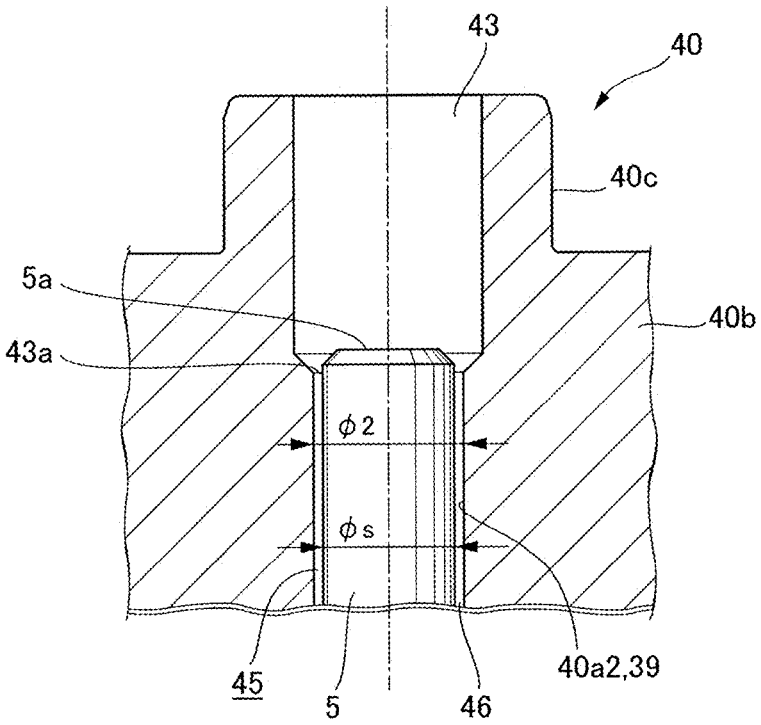

[Fig. 3]
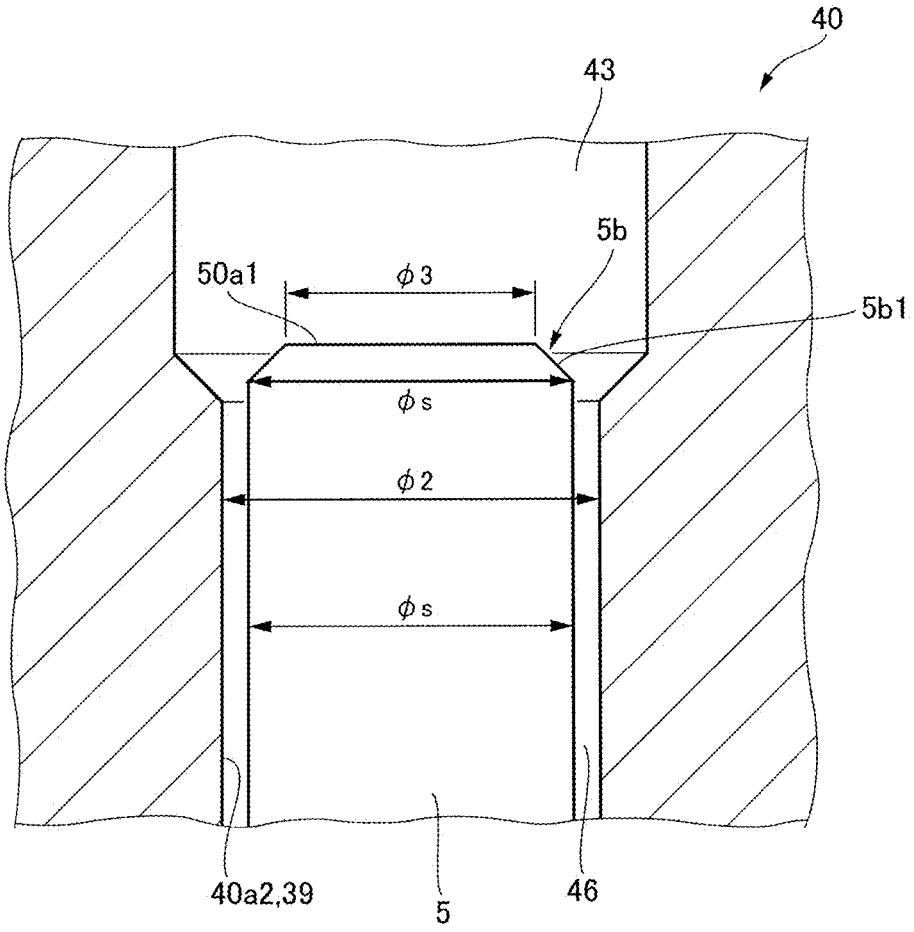

[Fig. 5]
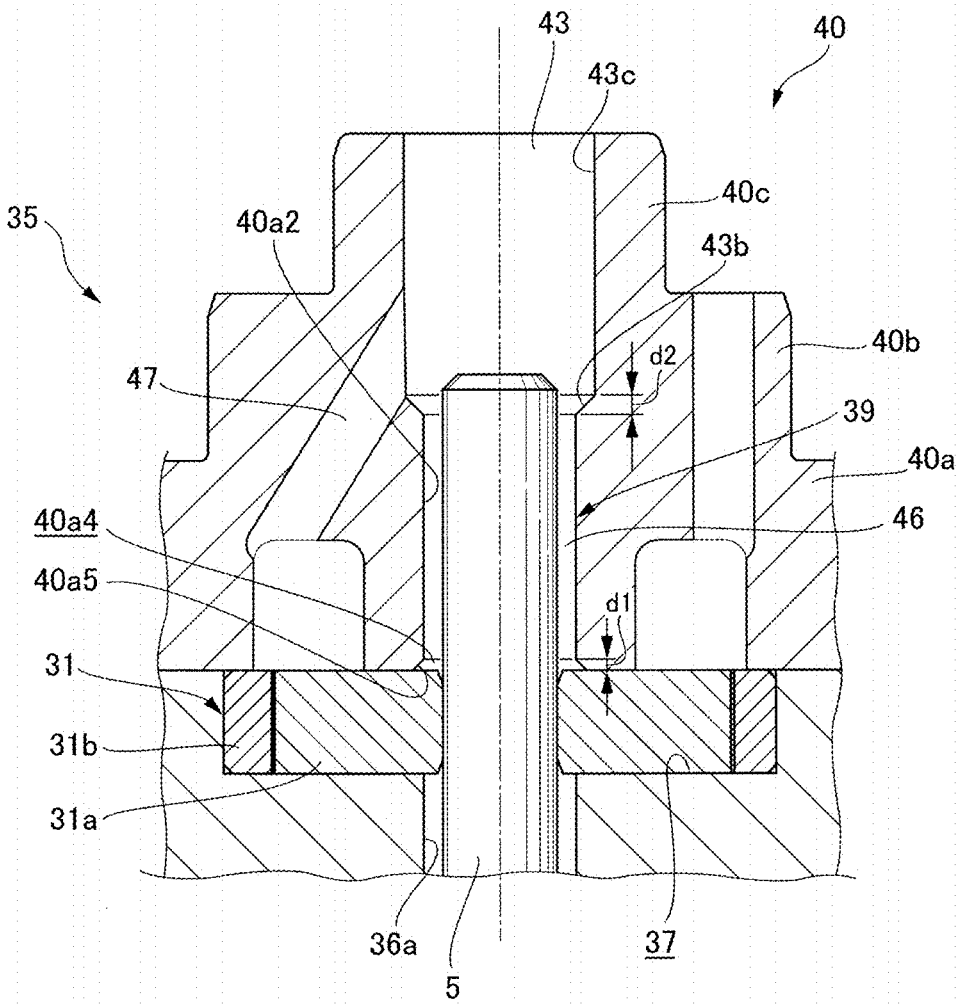

[Fig. 6]
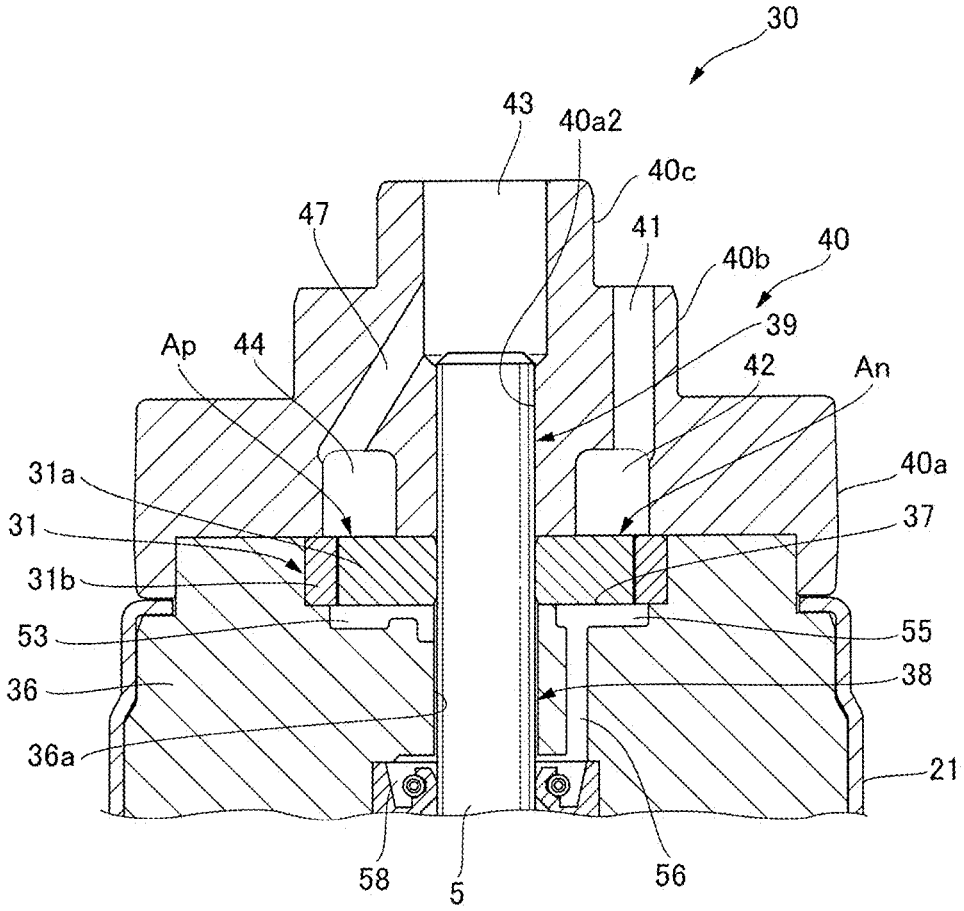

[Fig. 7]
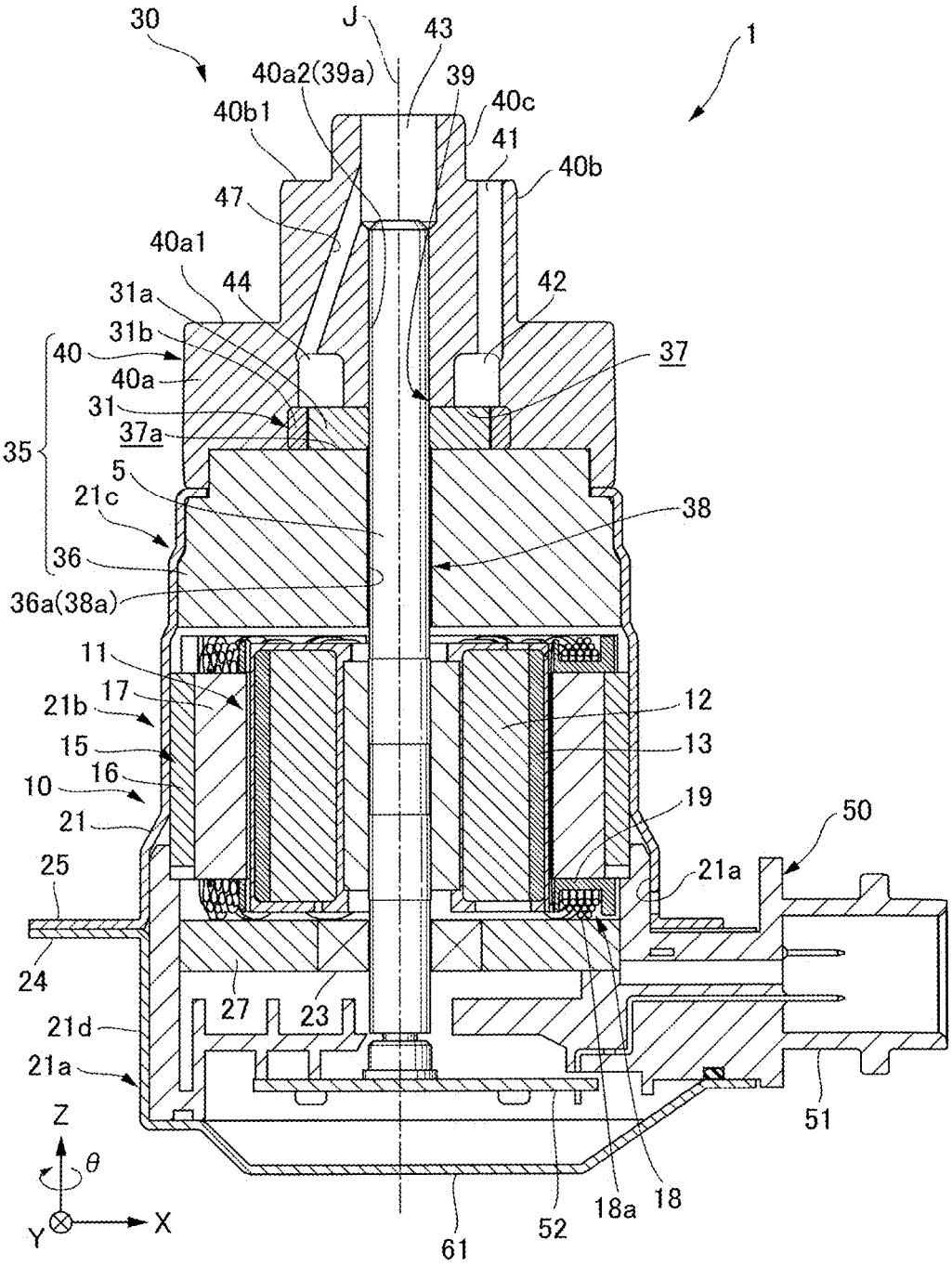

PUMP DEVICE

CROSS REFERENCE TO RELATED APPLICATIONS

This is the U.S. national stage of PCT Application No. PCT/JP2018/009457, filed on Mar. 12, 2018, and priority under 35 U.S.C. § 119(a) and 35 U.S.C. § 365(b) is claimed from Japanese Application No. 2017-057035, filed Mar. 23, 2017; the disclosures of which are incorporated herein by reference.

1. FIELD OF THE INVENTION

The present invention relates to a pump device.

2. BACKGROUND

In recent years, it has been important for an electric pump device that is used in a transmission mounted in a vehicle to adjust the amount of hydraulic oil to be supplied to the transmission.

For example, Japanese Unexamined Patent Application Publication No. 2013-163988 discloses an electric pump device capable of adjusting the amount of hydraulic oil. The electric pump device has a bearing in a pump case, a discharge port is disposed coaxially with a central axis, and an inlet port is disposed in a side surface of a motor case. The hydraulic oil suctioned from the inlet port is supplied to a pump disposed in the pump case via the inside of a motor chamber. The pump case has a communication hole via which the motor chamber and the pump case communicate. The communication hole can adjust the amount of the hydraulic oil discharged from the ejection port via the pump case by integrally rotating the pump case and the motor case in an axial direction to adjust the upward-downward position of the communication hole.

The pump disclosed in Japanese Unexamined Patent Application Publication No. 2013-163988 is a trochoid pump and has an inner gear that is fixed to an end portion of a shaft on one side in the axial direction and an outer gear that is disposed outward from the inner gear in the radial direction. The shaft that fixes the inner gear of the pump is supported by a bearing on the motor side while the ejection port side is not supported. That is, the shaft that fixes the inner gear is in a cantilever state. Therefore, in a case in which vibration generated during traveling of a vehicle is delivered to the pump via the transmission, there is concern that the shaft that fixes the inner gear may bend, the inner gear be brought into contact with the pump case, and a sliding resistance (frictional torque) during rotation of the pump rotor increase. Also, if not only vibration during traveling of the vehicle but also a pressure caused by the hydraulic oil are received by the inner gear, the inner gear may be pressed against a pump body of the pump case or a side surface of the pump cover, and a sliding resistance (friction torque) due to the rotation may increase.

Thus, a method of extending the shaft that fixes the inner gear on the ejection port side and supports the shaft is conceivable. However, in a case in which the shaft extending from the inner gear on the ejection port side is supported by a bearing, this leads to an increase in the number of parts and thus an increase in costs. Also, in a case in which the shaft is supported by a sliding bearing, there are disadvantages such as generation of heat and abrasion occurring due to friction between the shaft and the sliding bearing.

SUMMARY

Example embodiments of the present invention provide a pump device that is capable of preventing costs from increasing, preventing disadvantages such as heat generation and abrasion from occurring, and preventing a sliding resistance (friction torque) during rotation of a pump rotor from increasing.

According to example embodiments of the present invention, there is provided a pump device including a motor portion that includes a shaft that is rotatably supported about a central axis extending in an axial direction, and a pump portion that is located on one side of the motor portion in the axial direction and that is driven by the motor portion via the shaft such that it discharges oil. The pump portion includes a pump rotor that rotates along with the shaft projecting from the motor portion and a pump housing that includes an accommodation portion that accommodates the pump rotor. The pump housing includes a pump body that includes a first bearing portion rotatably supporting the shaft and a pump cover that covers the pump body on one side in the axial direction such that the accommodation portion is disposed between the pump cover and the pump body. The pump cover includes a flow path through which the oil is discharged and suctioned. The pump cover includes a second bearing portion that rotatably supports the shaft and communicates with the flow path. An end portion of the shaft on one side in the axial direction is disposed at the second bearing portion or inside the flow path.

According to preferred embodiments of the present invention, it is possible to provide a pump device capable of preventing costs from increasing, preventing disadvantages such as heat generation and abrasion from occurring, and preventing a sliding resistance (friction torque) during rotation of a pump rotor from increasing.

The above and other elements, features, steps, characteristics and advantages of the present disclosure will become more apparent from the following detailed description of the example embodiments with reference to the attached drawings.

BRIEF DESCRIPTION OF THE DRAWINGS

FIG. 1 is a sectional view of a pump device according to a first example embodiment of the present invention.

FIG. 2 is an enlarged sectional view of main portions of the pump device according to the first example embodiment.

FIG. 3 is a main portion sectional view of an axis portion according to the first example embodiment.

FIG. 5 is a main portion sectional view of a pump housing according to the first example embodiment.

FIG. 6 is a main portion sectional view of a pump housing according to a modification example of the first example embodiment.

FIG. 7 is a sectional view of a pump device according to another modification example of the first example embodiment.

DETAILED DESCRIPTION

Figure 4A:
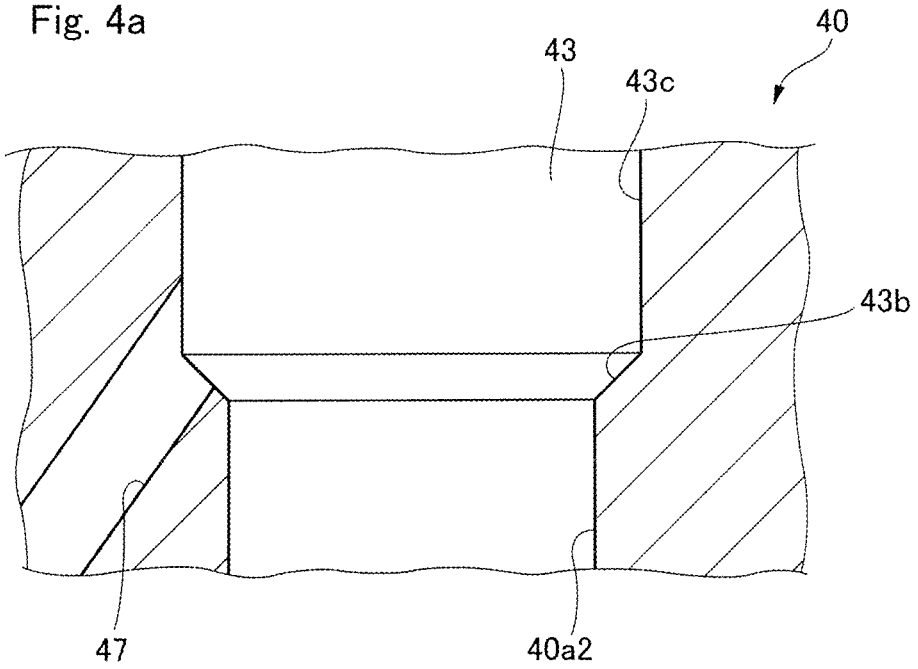
FIGS. 4*a* and 4*b* are partial sectional views of a pump cover that has an ejection flow path according to the first example embodiment.

Hereinafter, a pump device according to an example embodiment of the disclosure will be described with reference to drawings. However, dimensions, materials, shapes, relative arrangements, and the like of components described in the example embodiment or illustrated in the drawings are not intended to limit the scope of the disclosure to the aforementioned details and are merely explanatory examples. For example, expressions representing relative or primary arrangements such as "in a specific direction", "along a specific direction", "parallel", "orthogonal", "center", "concentric", and "coaxial" not only strictly represent such arrangements but also represent states obtained after relative displacement with a tolerance or at angles and distances to such extents to which the same functions can be obtained. For example, expressions representing a state in which some matters are equal to each other, such as "the same", "equal", and "uniform", not only represent strictly equal states but also represent states in which a tolerance or differences to such an extent that the same functions are obtained are present. For example, expressions representing shapes, such as a square shape and a cylindrical shape, not only represent shapes such as a square shape and a cylindrical shape in a geometrically strict sense but also represent shapes including recessed or projecting portions and chamfered portions within a range in which the same advantages can be obtained. Meanwhile, expressions such as "comprising", "prepared with", "provided with", "including", or "having" are not exclusive expressions that exclude the presence of other components.

Also, an XYZ coordinate system is appropriately illustrated as a three-dimensional orthogonal coordinate system in the drawings. In the XYZ coordinate system, the Z-axis direction is a direction parallel to the axial direction of a central axis J illustrated in FIG. 1. The X-axis direction is a direction parallel to a short direction of the pump device illustrated in FIG. 1, that is, an upward/downward direction in FIG. 1. The Y-axis direction is a direction that perpendicularly intersects both the X-axis direction and the Z-axis direction.

In the following description, the positive side in the Z-axis direction (+Z side) will be described as a "front side", and the negative side (−Z side) in the Z-axis direction will be referred to as a "rear side. Note that the rear side and the front side are simply names used for explanation and do not limit actual positional relationships and directions. Also, the direction (Z-axis direction) parallel to the central axis J will be simply referred to as an "axial direction", a radial direction about the central axis J will be simply referred to as a "radial direction", and a circumferential direction about the central axis J, that is, a circumference of the central axis J (0 direction) will be simply referred to as a "circumferential direction".

Note that extending in the axial direction described in the specification includes extending in a direction inclined within a range of less than 45° relative to the axial direction in addition to extending strictly in the axial direction (Z-axis direction). Also, extending in the radial direction described in the specification includes extending in a direction inclined within a range of 45° or less relative to the radial direction in addition to extending strictly in the radial direction, that is, in a direction that is orthogonal to the axial direction (Z-axis direction).

FIG. 1 is a perspective view of a pump device according to a first example embodiment. FIG. 2 is an enlarged sectional view of main portions of the pump device.

First Example Embodiment

The pump device 1 according to the example embodiment has a motor portion 10 and a pump portion 30 as illustrated in FIG. 1. The motor portion 10 has a shaft 5 that is disposed along the central axis J extending in the axial direction. The pump portion 30 is located on one side of the motor portion 10 in the axial direction and is driven by the motor portion 10 via the shaft 5 to eject oil. That is, the motor portion 10 and the pump portion 30 are provided so as to be aligned along the axial direction. Hereinafter, each components will be described in detail.

<Motor Portion 10>

The motor portion 10 has a housing 21, a rotor 11, a shaft 5, a stator 15, and a bearing 23 as illustrated in FIG. 1.

The motor portion 10 is an inner rotor-type motor, for example, the rotor 11 being fixed to an outer circumferential surface of the shaft 5, and the stator 15 being located outside the rotor 11 in the radial direction. Also, the bearing 23 is disposed at an end portion of the shaft 5 on the rear side (−Z side) in the axial direction and rotatably supports the shaft 5.

(Housing 21)

The housing 21 has a thin cylindrical shape with a bottom as illustrated in FIG. 1 and has a bottom surface portion 21*a*, a stator holding portion 21*b*, a pump body holding portion 21*c*, a side wall portion 21*d*, and flange portions 24 and 25. The bottom surface portion 21*a* serves as a bottom portion, and the stator holding portion 21*b*, the pump body holding portion 21*c*, and the side wall portion 21*d* serve as side wall surfaces with a cylindrical shape about the central axis J. In the example embodiment, the inner diameter of the stator holding portion 21*b* is greater than the inner diameter of the pump body holding portion 21*c*. To an inner side surface of the stator holding portion 21*b*, an outer surface of the stator 15, that is, an outer surface of a core back portion 16, which will be described later, is fitted. In this manner, the stator 15 is accommodated in the housing 21.

The flange portion 24 extends outward in the radial direction from an end portion of the side wall portion 21*d* on the front side (+Z side). Meanwhile, the flange portion 25 expands from an end portion of the stator holding portion 21*b* on the rear side (−Z side) to the outside in the radial direction. The flange portion 24 and the flange portion 25 face one another and are fastened with a fastening means, which is not illustrated in the drawing. In this manner, the motor portion 10 and the pump portion 30 are sealed inside and fixed to the housing 21.

Examples of a material for the housing 21 that can be used include a zinc-aluminum-magnesium-based alloy, and specific examples that can be used include molten zinc-aluminum-magnesium alloy plating steel plates and steel strips. Since the housing 21 is thus made of metal, has high heat conductivity, and has a large surface area, the housing 21 has an excellent heat discharging effect. Also, a bearing holding portion 27 for holding the bearing 23 is provided at the bottom surface portion 21*a*.

(Rotor 11)

The rotor 11 has a rotor core 12 and a rotor magnet 13. The rotor core 12 surrounds the shaft 5 around the axis (6 direction) and is fixed to the shaft 5. The rotor magnet 13 is fixed to the outer surface around the axis (6 direction) of the rotor core 12. The rotor core 12 and the rotor magnet 13 rotate along with the shaft 5.

(Stator 15)

The stator 15 surrounds the rotor 11 around the axis (6 direction) and causes the rotor 11 to rotate about the central axis J. The stator 15 has a core back portion 16, teeth portions 17, a coil 18, and an insulator (bobbin) 19.

The shape of the core back portion 16 is a cylindrical shape that is coaxial with the shaft 5. The teeth portions 17 extend from the inner side surface of the core back portion 16 toward the shaft 5. The plurality of teeth portions 17 are provided by being disposed at uniform intervals in a circumferential direction of the inner side surface of the core back portion 16. The coil 18 is provided in the circumference of the insulator (bobbin) 19 and is obtained by a conductive wire 53*a* being wound therearound. The insulator (bobbin) 19 is attached to respective teeth portions 17.

(Bearing 23)

The bearing 23 is disposed on the side to the rear (−Z side) of the rotor 11 and the stator 15 and is held by the bearing holding portion 27. The bearing 23 supports the shaft 5. The shape, the structure, and the like of the bearing 23 are not particularly limited, and any known bearing can be used.

(Shaft 5)

The shaft 5 extends along the central axis J and penetrates through the motor portion 10. The shaft 5 on the front side (+Z side) projects from the motor portion 10 and extends into the pump portion 30. An end portion of the shaft 5 on the front side (+Z side) is disposed inside a flow path 43 of a pump cover 40, which will be described later. The shaft 5 on the rear side (−Z side) is supported by the bearing 23 that projects from the motor portion 10 and is attached to the inside of a bus bar holder 50. In the example embodiment illustrated in the drawing, the bearing 23 is a ball bearing.

<Pump Portion 30>

The pump portion 30 is located on one side of the motor portion 10 in the axial direction, specifically, on the side in front (+Z side). The pump portion 30 is driven by the motor portion 10 via the shaft 5. The pump portion 30 has a pump rotor 31 and a pump housing 35. The pump housing 35 has a pump body 36 and a pump cover 40. Hereinafter, each part will be described in detail.

(Pump Body 36)

The pump body 36 is fixed to the inside of the housing 21 on the front side (+Z side) on the front side (+Z side) of the motor portion 10. The pump body 36 has an accommodation portion 37 that accommodates the pump rotor 31 and that has side surfaces and a bottom surface located on the other side of the motor portion 10 in the axial direction. The accommodation portion 37 opens on the front side (+Z side) and is recessed on the rear side (−Z side). The shape of the accommodation portion 37 when seen in the axial direction is a circular shape.

The pump body 36 has a through-hole 36*a* that penetrates along the central axis J. The through-hole 36*a* has both ends opening in the axial direction such that the shaft 5 is caused to pass therethrough, the opening on the front side (+Z side) is opened to the accommodation portion 37, and the opening on the rear side (−Z side) is opened on the side of the motor portion 10. The through-hole 36*a* serves as a sliding bearing that rotatably supports the shaft 5. The through-hole 36*a* will be referred to as a first bearing portion 38 below.

(Pump Rotor 31)

The pump rotor 31 is attached to the shaft 5. More specifically, the pump rotor 31 is attached to the shaft 5 on the front side (+Z side). The pump rotor 31 has an inner rotor 31*a* that is attached to the shaft 5 and an outer rotor 31*b* that surrounds the outside of the inner rotor 31*a* in the radial direction. The inner rotor 31*a* has an annular shape. The inner rotor 31*a* is a gear that has teeth on an outer surface in the radial direction.

The inner rotor 31*a* is fixed to the shaft 5. More specifically, an end portion of the shaft 5 on the front side (+Z side) is press-fitted to the inside of the inner rotor 31*a*. The inner rotor 31*a* rotates about the axis (θ direction) along with the shaft 5. The outer rotor 31*b* is an annular shape surrounds the outside of the inner rotor 31*a* in the radial direction. The outer rotor 31*b* is a gear with teeth on the inner side surface in the radial direction.

The inner rotor 31*a* and the outer rotor 31*b* mesh with each other, and the outer rotor 31*b* is rotated by the inner rotor 31*a* rotating. That is, the pump rotor 31 rotates by the shaft 5 rotating. In other words, the motor portion 10 and the pump portion 30 have the same rotation axis. In this manner, it is possible to prevent the size of the electric pump device from increasing in the axial direction. Also, a volume at the engaging portion between the inner rotor 31*a* and the outer rotor 31*b* changes due to the inner rotor 31*a* and the outer rotor 31*b* rotating. A region in which the volume decreases is a pressurized area Ap, and a region in which the volume increases is a negative pressure region An. An inlet port 42 is disposed on one side (front side) of the negative pressure region An of the pump rotor 31 in the axial direction. Also, an ejection port 44 is disposed on one side (front side) of the pressurized region Ap of the pump rotor in the axial direction. Here, the oil suctioned into the accommodation portion 37 from the inlet port 41 provided in the pump cover 40 is accommodated in the volume portion between the inner rotor 31*a* and the outer rotor 31*b*, and is sent to the pressurized area Ap. Thereafter, the oil is discharged from the flow path 43.

(Pump Cover 40)

The pump cover 40 covers the pump body 36 on one side (front side) in the axial direction such that the accommodation portion 37 is provided between the pump cover 40 and the pump body 36. In the example embodiment illustrated in FIG. 1, the pump cover 40 is attached to the pump body 36 on the front side (+Z side) and blocks the opening portion 37*a* that is opened in the accommodation portion 37 on the front side (+Z side) in the axial direction such that the accommodation portion 37 is provided between the pump cover 40 and the pump body 36. The pump cover 40 has a disc-shaped cover main body 40*a* expanding in the radial direction. The cover main body 40*a* blocks the opening portion 37*a* of the accommodation portion 37 on the front side (+Z side).

The cover main body 40*a* has a first stepped portion 40*b* and a second stepped portion 40*c* that project on the front side (+Z side) in the axial direction. The first stepped portion 40*b* has a cylindrical shape, is provided substantially coaxially with the central axis J, and is connected to the end portion of the surface 40*a*1 on the side of the central axis on the front side (+Z side) of the cover main body 40*a* in the axial direction. The cover main body 40*a* has a through-hole 40*a*2 along the central axis J. The through-hole 40*a*2 penetrates between both end portions of the pump cover 40 in the axial direction. The shaft 5 is caused to pass into the through-hole 40*a*2. The through-hole 40*a*2 has a flow path 43 with a diameter expanding on the front side (+Z side) in the axial direction. The flow path 43 ejects the oil supplied from the pump rotor 31. That is, the flow path 43 serves as an ejection port in the example embodiment illustrated in the drawing.

The through-hole 40*a*2 provided in the pump cover 40 has the flow path 43 on the front side (+Z side), and an opening on the rear side (−Z side) is opened to face the accommodation portion 37. The through-hole 40*a*2 serves as a sliding bearing that rotatably supports the shaft 5. The through-hole 40*a*2 will be referred to as a second bearing portion 39 below.

The second stepped portion 40*c* is provided substantially coaxially with the central axis J and has a cylindrical shape with a smaller diameter than the diameter of the first stepped portion 40*b*. The second stepped portion 40*c* is connected to an end portion of a surface 40*b*1 on the side of the central axis of the first stepped portion 40*b* on the front side (+Z side) in the axial direction. The second stepped portion 40*c* has the flow path 43 along the central axis J. That is, the flow path 43 is provided over the first stepped portion 40*b* and the second stepped portion 40*c*.

As illustrated in FIG. 2, the through-hole 40*a*2 provided in the pump cover 40 is a second bearing portion 39 and serves as a sliding bearing. Therefore, the inner diameter ϕ2 of the through-hole 40*a*2 is greater than the outer diameter ϕS of the shaft 5. Therefore, a clearance 45 is provided between the shaft that is caused to pass into the through-hole 40*a*2 and the through-hole 40*a*2. The clearance 45 serves as a feeding flow path through which the oil in the accommodation portion 37 illustrated in FIG. 1 is fed to the flow path 43. Also, an end portion 5*a* of the shaft 5 on one side in the axial direction is disposed inside the flow path 43. In the example embodiment illustrated in the drawing, the end portion 5*a* on one side in the axial direction is disposed so as to extend into the flow path 43. Note that a case in which the end portion 5*a* of the shaft 5 on one side in the axial direction is disposed at a position at which the end portion 5*a* is brought into contact with an end 43*a* of the flow path 43 on the rear side is also included as a case in which the end portion 5*a* of the shaft 5 on one side in the axial direction is disposed in the flow path 43.

In addition, the end portion 5*a* of the shaft 5 on one side in the axial direction may be disposed in the second bearing portion 39. That is, the end portion 5*a* of the shaft 5 on one side in the axial direction may be disposed inside the through-hole 40*a*2 instead of the shaft 5 projecting into the flow path 43.

The pump cover 40 has an ejection flow path 47 that connects the ejection port 44 to the flow path 43 as illustrated in FIG. 1. Therefore, the oil supplied from the accommodation portion 37 is supplied to the flow path 43 via the ejection flow path 47. Also, the pump cover 40 has the inlet port 41 that is connected to the inlet port 42. In the example embodiment illustrated in the drawing, an end portion of the inlet port 41 on the rear side is opened at the inlet port 42, and an end portion of the inlet port 41 on the front side is opened in the surface 40*b*1 of the first stepped portion 40*b* on the front side (+Z side).

<Effects and Advantages of Pump Device 1>

Next, effects and advantages of the pump device 1 will be described. As illustrated in FIG. 1, if the motor portion 10 of the pump device 1 is driven, the shaft 5 of the motor portion rotates, and the outer rotor 31*b* also rotates along with rotation of the inner rotor 31*a* of the pump rotor 31. If the pump rotor 31 rotates, the oil suctioned from the inlet port 41 of the pump portion 30 moves inside the accommodation portion 37 of the pump portion 30 and is discharged from the flow path 43 via the ejection port 44 and the ejection flow path 47.

Here, in the pump portion 30 according to the example embodiment, the shaft 5 extending on the side of the motor portion 10 beyond the pump rotor 31 is supported by the first bearing portion 38, and the shaft 5 extending on the side of the pump cover 40 beyond the pump rotor 31 is supported by the second bearing portion 39. That is, the respective parts of the shaft 5 of the pump rotor 31 extending from both sides of the pump rotor 31 with the pump rotor 31 located at the center thereof are rotatably supported. Therefore, even in a case in which an external force such as vibration acts on the pump rotor 31 during rotation of the pump rotor 31 or the inner rotor 31*a* receives a pressure caused by the oil, it is possible to prevent a concern that the shaft 5 deviates with respect to the central axis. Therefore, it is possible to prevent a concern that the inner rotor 31*a* fixed to the shaft 5 is brought into contact with the accommodation portion 37. Accordingly, it is possible to prevent a sliding resistance (friction torque) during rotation of the pump rotor 31 from increasing.

Also, since the end portion 5*a* of the shaft 5 on one side in the axial direction is disposed inside the flow path 43, a part of the oil in the accommodation portion 37 flows to the side of the flow path 43 through the clearance 45 between the shaft 5 and the second bearing portion 39. That is, the oil supplied from the accommodation portion 37 is discharged from the flow path 43 via the ejection flow path 47 during rotation of the shaft 5 while the pressure in the flow path 43 is reduced during ejection of the oil from the flow path 43. In addition, the oil is viscous. Therefore, the oil adhering to the side surface of the shaft 5 moves to the side of the flow path 43 while moving in the circumferential direction along the side surface of the shaft 5 and then reaches the end portion 5*a* of the shaft 5 on one side in the axial direction during the rotation of the shaft 5. The oil that has moved to the end portion 5*a* of the shaft 5 on one side in the axial direction is caused to fly into the flow path 43 due to a centrifugal force caused by the rotation of the shaft 5. The oil that has been caused to fly into the flow path 43 is discharged from the flow path 43 along with the oil that has flown into the flow path 43 via the ejection flow path 47.

Therefore, the oil is distributed through the feeding flow path 46 between the shaft 5 and the second bearing portion 39 during the rotation of the shaft 5. Therefore, it is possible to reduce, by the oil, heat, abrasion, and the like generated by contact between the shaft 5 and the second bearing portion 39. Also, since the second bearing portion 39 is a through-hole 40*a*2 and has a simple configuration, it is possible to prevent costs for the pump device 1 from increasing.

Note that in a case in which the end portion 5*a* of the shaft 5 on one side in the axial direction is disposed inside the through-hole 40*a*2, the oil adhering to the side surface of the shaft 5 during the rotation of the shaft 5 reaches the end portion 5*a* of the shaft 5 on one side in the axial direction while moving in the circumferential direction along the side surface of the shaft 5. The oil that has moved to the one end portion 5*a* of the shaft 5 on one side in the axial direction is suctioned from the flow path 43 with a reduced pressure. Therefore, since the oil is distributed to the feeding flow path 46 between the shaft 5 and the second bearing portion 39, it is possible to reduce heat, abrasion, and the like caused by contact between the shaft 5 and the second bearing portion 39.

(Inclined Surface 5*b*1)

FIG. 3 is a main portion sectional view of an axial portion according to the first example embodiment. As illustrated in FIG. 3, the end portion 5*a* of the shaft 5 on one side in the axial direction has a corner portion 5*b* that has an inclined surface 5*b*1 with a diameter reducing toward one side in the axial direction. The end surface Sal of the shaft 5 on one side in the axial direction is a tip end surface with a smaller diameter than the diameter ϕS of the shaft 5. The inner diameter ϕ2 of the through-hole 40*a*2 is greater than the diameter ϕ3 of the end surface 5*a*1 on one side in the axial direction. That is, ϕ2>ϕ3.

Therefore, referring to FIGS. 1 and 3 for explanation, the tip end portion of the shaft 5 extending from the pump body 36 is inserted into the through-hole 40*a*2 provided in the pump cover 40 when the pump cover 40 is attached to the pump body 36. Even if the central axis J of the shaft 5 deviates with respect to the central axis of the through-hole 40*a*2 at the time of the insertion of the shaft 5, the inclined surface 5*b*1 of the shaft 5 is in contact with an opening edge portion of the through-hole 40*a*2 on the side of the motor portion, and the inclined surface 5*b*1 guides the shaft 5 into the through-hole 40*a*2 with the movement of the pump cover 40 to approach the pump body 36. Therefore, it is possible to easily insert the tip end portion of the shaft 5 extending from the motor portion 10 into the through-hole 40*a*2 provided in the pump cover 40. Accordingly, it is possible to improve assembling properties with respect to the pump cover 40 and the pump body 36.

(Through-Hole 40*a*2)

Also, the inner diameter ϕ2 of the through-hole 40*a*2 is greater than the diameter ϕS of the end of the inclined surface 5*b*1 on the other side in the axial direction. In the example embodiment, a case in which the diameter ϕS of the end of the inclined surface 5*b*1 on the other side in the axial direction is the same as the diameter ϕS of the shaft 5 will be described. Here, in a case in which the diameter ϕS of the end of the inclined surface 5*b*1 on the other side in the axial direction has substantially the same dimension as that of the inner diameter ϕ2 and the end of the shaft 5 on the other side in the axial direction is inserted into the through-hole 40*a*2, there is a concern that the end of the inclined surface 5*b*1 on the other side in the axial direction will catch in the through-hole 40*a*2 if the direction of the central axis J of the shaft 5 is inclined with respect to the central axis of the through-hole 40*a*2. Therefore, it is possible to reduce concern that the end of the inclined surface 5*b*1 on the other side in the axial direction is caught in the through-hole 40*a*2 when the shaft 5 is inserted into the through-hole 40*a*2 by setting the inner diameter ϕ2 of the through-hole 40*a*2 to be greater than the diameter ϕS of the end of the inclined surface 5*b*1 on the other side in the axial direction. Accordingly, it is possible to improve assembling properties between the pump cover 40 and the pump body 36.

Note that since the through-hole 40*a*2 serves as a sliding bearing that rotatably supports the shaft 5, the dimensional difference between ϕ2 and ϕS is a dimensional difference with which the sliding bearing can be realized, for example, a dimensional difference in accordance with a fitting into a clearance.

(Ejection Flow Path 47)

Figure 4B:
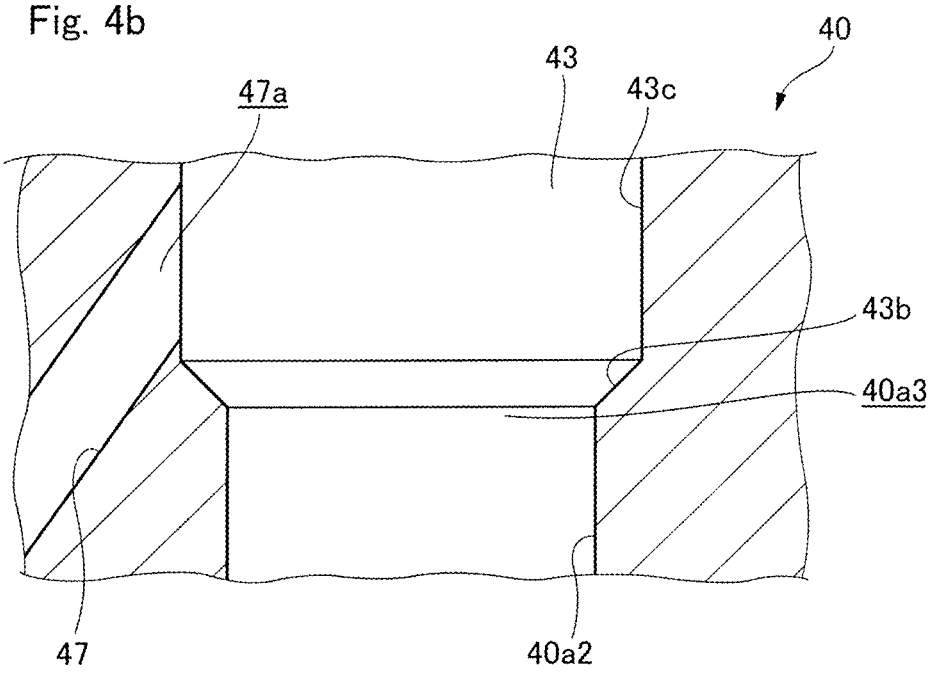

FIGS. 4*a* and 4*b* are partial sectional views of the pump cover that has the ejection flow path according to the first example embodiment. As illustrated in FIG. 1, the pump cover 40 has an ejection port 44 that ejects the oil supplied from the pump rotor 31 and an ejection flow path 47 via which the ejection port 44 and the flow path 43 communicate. The flow path 43 has an annular flow path-side chamfered surface 43*b* with a diameter increasing toward one side in the axial direction that is provided at a corner portion of the end portion of the flow path 43 on the other side in the axial direction and a tubular surface 43*c* that is connected to the end of the flow path-side chamfered surface 43*b* on one side in the axial direction and that extends on one side in the axial direction, as illustrated in FIG. 4*a*. The ejection flow path 47 is connected to one side in the axial direction beyond the end of the flow path-side chamfered surface 43*b* on the other side in the axial direction.

In the example embodiment illustrated in the drawing, the ejection flow path 47 is connected to one side (front side) in the axial direction beyond the end of the flow path-side chamfered surface 43*b* on the other side in the axial direction, and a part of the ejection flow path 47 is connected to the tubular surface 43*c* extending on one side (front side) in the axial direction beyond the end of the flow path-side chamfered surface 43*b* on one side in the axial direction.

Therefore, in a case in which the flow path 43 and the ejection flow path 47 are provided in the pump cover 40 through cutting working (for example, using a drilling machine), it is possible to insert a drill that serves as a cutting blade from the flow path 43 and to bring the tip end of the drill into contact with the flow path-side chamfered surface 43*b* when the ejection flow path 47 is cut after the flow path 43 is cut. At this time, since the flow path-side chamfered surface 43*b* is inclined in a direction in which the diameter increases toward one side in the axial direction, it is possible to bring the drill into contact while causing the drill to face a direction that substantially orthogonally intersects the flow path-side chamfered surface 43*b* if the drill is inserted from the flow path 43 while inclined. Therefore, it becomes easy to position the tip end of the drill, thereby improving operability of the cutting work for the ejection flow path 47.

Also, as illustrated in FIG. 4*b*, the ejection flow path 47 may be connected to the tubular surface 43*c*. In this case, it is possible to provide the opening portion 47*a* that is opened in the tubular surface 43*c* of the ejection flow path 47 at a position that is separated from the opening portion 40*a*3 of the through-hole 40*a*2 on the side of the flow path 43. Therefore, it is possible to reduce the concern that the tip end portion of the shaft 5 is caught in the opening portion 47*a* that is opened in the tubular surface 43*c* of the ejection flow path 47 during assembly of the pump cover 40 and the pump body 36. Therefore, it is possible to improve operability in the assembling work between the pump cover 40 and the pump body 36.

(Pump Rotor-Side Chamfered Surface 40*a*5)

FIG. 5 is a main portion sectional view of the pump housing according to the first example embodiment. As illustrated in FIG. 5, an annular pump rotor-side chamfered surface 40*a*5 with a diameter reduced toward one side of the through-hole 40*a*2 in the axial direction is provided at a corner portion of the opening portion 40*a*4 of the through-hole 40*a*2 on the side of the accommodation portion 37. The depth d1 of the pump rotor-side chamfered surface 40*a*5 in the axial direction is smaller than the depth d2 of the flow path-side chamfered surface 43*b* in the axial direction. That is, $d1<d2$.

If the depth d1 of the pump rotor-side chamfered surface 40*a*5 in the axial direction increases, the length of the second bearing portion 39 in the axial direction decreases, a flow path resistance of the oil flowing through the feeding flow path 46 decreases, and the amount of flowing oil thus increases. Therefore, the oil flowing in the accommodation portion 37 decreases, and the amount of flowing oil discharged from the ejection flow path 47 via the flow path 43 decreases. However, the amount of oil flowing in the feeding flow path 46 is prevented from increasing by setting the depth d1 of the pump rotor-side chamfered surface 40*a*5 in the axial direction to be smaller than the depth d2 of the flow path-side chamfered surface 43*b* on the side of the axial direction. Therefore, it is possible to prevent the amount of flowing oil discharged from the flow path 43 via the ejection flow path 47 from decreasing.

(Lengths of First Bearing Portion 38 and Second Bearing Portion 39)

As described above, the shaft 5 that supports the pump rotor 31 is supported by the first bearing portion 38 that is provided on the side of the pump body 36 and the second bearing portion 39 that is provided on the side of the pump cover 40 as illustrated in FIG. 1. Here, the lengths L1 and L2 of the respective bearing surfaces 38*a* and 39*a* of the first bearing portion 38 and the second bearing portion 39 (hereinafter, these will be collectively referred to as "bearings 38 and 39") in the axial direction are the same. That is, L1=L2.

An oil pressure acting on the pump rotor 31 acts on the bearing surfaces 38*a* and 39*a* of the bearings 38 and 39 between the shaft 5 and the bearings 38 and 39 during driving of the pump rotor 31. If the oil pressure exceeds a load per a unit area acting on the bearing surfaces 38*a* and 39*a*, that is, if the surface pressure exceeds material strength of the bearings 38 and 39, there is a concern that the bearings 38 and 39 may be damaged. Thus, it is necessary to set the bearing lengths of the respective bearing surfaces 38*a* and 39*a* of the first bearing portion 38 and the second bearing portion 39 such that the surface pressure is not greater than the material strength of the bearings 38 and 39.

Also, if the inner rotor 31*a* of the pump rotor 31 is inclined with respect to the shaft 5 and is brought into contact with the wall surface of the accommodation portion 37 due to the oil pressure acting on the pump rotor 31, a friction torque increases. Meanwhile, if the lengths of the bearings 38 and 39 in the axial direction increase, the contact areas between the shaft 5 and the bearings 38 and 39 increase, and a sliding resistance thus increases. Therefore, it is better for the lengths of the bearing surfaces 38*a* and 39*a* of the bearings 38 and 39 to be shorter. However, if the lengths of the bearing surfaces 38*a* and 39*a* of the bearings 38 and 39 are set to be short, a concern that the support of the pump rotor 31 becomes unstable increases.

Thus, the lengths of the bearing surfaces 38*a* and 39*a* of the bearings 38 and 39 in the axial direction are preferably minimum required lengths among lengths with which the surface pressure is not greater than the material strength. In the example embodiment illustrated in the drawing, the lengths L1 and L2 of the respective bearing surfaces 38*a* and 39*a* of the first bearing portion 38 and the second bearing portion 39 in the axial direction are the same in a case in which the materials of the pump cover 40 and the pump body 36 are the same, for example, cast iron. That is, L1=L2. Note that in a case in which materials for forming the pump cover 40 and the pump body 36 are different from each other, the lengths L1 and L2 in the axial direction are not the same since the minimum required lengths are different from each other.

Also, the lengths L1 and L2 of the respective bearing surfaces 38*a* and 39*a* of the first bearing portion 38 and the second bearing portion 39 in the axial direction are preferably longer than the length L3 of the pump rotor 31 in the axial direction. That is, L1, L2>L3.

A force acting on the shaft 5 from the pump rotor 31 depends on the size of the pump rotor 31. The force acting on the shaft 5 acts on the first bearing portion 38 and the second bearing portion 39 via the shaft 5, and it is necessary that the surface pressure acting on the first bearing portion 38 and the second bearing portion 39 due to the force be not greater than the material strength. Here, in a case in which the lengths L1 and L2 of the respective bearing surfaces 38*a* and 39*a* of the first bearing portion 38 and the second bearing portion 39 in the axial direction are set to be longer than the lengths of the pump rotor 31 in the axial direction, it is possible to reduce the surface pressure acting on the bearing surfaces 38*a* and 39*a* due to the force acting on the shaft 5 from the pump rotor 31. Therefore, in a case in which a plurality of pump devices that have pump rotors 31 with different sizes are designed, it is possible to facilitate the design of such pump devices that the surface pressures on the first bearing portion 38 and the second bearing portion 39 of each of the plurality of pump devices are not greater than the material strength.

Note that although the case in which the inlet port 42 is disposed on one side in the left-right direction with respect to the axial direction of the shaft 5 and the ejection port 44 is disposed on the other side in the left-right direction with respect to the axial direction of the shaft 5 as illustrated in FIG. 1 has been described in the aforementioned example embodiment, the inlet port 42 may be disposed on the other side of the shaft 5 in the left-right direction, and the ejection port 44 may be disposed on one side of the shaft 5 in the left-right direction. In this case, the pressurized region Ap represented by the two-dotted chain line in the pump rotor 31 is disposed on one side in the left-right direction with respect to the axial direction of the shaft 5, and the negative pressure region An represented by the two-dotted chain line is disposed on the other side in the left-right direction with respect to the axial direction of the shaft 5. In addition, the flow path 43 serves as an inlet port, and the inlet port 41 serves as an ejection port. Therefore, the oil flows to the side of the negative pressure region An via the ejection flow path 47 after being suctioned into the flow path 43 during the rotation of the pump rotor 31, is accommodated in the volume portion between the inner rotor 31*a* and the outer rotor 31*b*, and is then fed to the side of the pressurized region Ap. Thereafter, the oil is discharged from the inlet port 41.

[Modification Example of First Example Embodiment]

FIG. 6 is a main portion sectional view of a pump housing according to a modification example of the first example embodiment. As illustrated in FIG. 6, a supply port 53 for supplying a pressurized oil to the side of the first bearing portion 38 is provided at the pump body 36 on the other side (rear side) of the pressurized region Ap of the pump rotor 31 in the axial direction. Also, a collection port 55 for collecting an oil adhering to the shaft 5 is provided at the pump body 36 on the other side (rear side) of the negative pressure region An of the pump rotor 31 in the axial direction.

In the example embodiment illustrated in the drawing, the supply port 53 is opened in a bottom surface of the accommodation portion 37 that faces the pressurized region Ap of the pump rotor 31 on the rear side (−Z side) in the axial direction and is recessed on the side of the motor portion 10. The supply port 53 is opened in an inner surface of the through-hole 36*a* that extends from the pressurized region Ap of the pump rotor 31 to the side of the shaft 5 and is located at a position at which the through-hole 36*a* faces the side surface of the shaft 5.

Meanwhile, the collection port 55 is opened in the bottom surface of the accommodation portion 37 that faces the negative pressure region An of the pump rotor 31 on the other side (rear side) in the axial direction and is recessed on the side of the motor portion 10. A collection flow path 56 for collecting the oil supplied to the shaft 5 that is supported by the first bearing portion 38 communicates with the collection port 55. In the example embodiment illustrated in the drawing, the collection flow path 56 has one end opened at the collection port 55 and the other end side extending on the side of the motor portion 10 along the axial direction of the shaft 5 inside the pump body 36 and having a direction changed on the side of the shaft 5, and the other end is opened in the inner surface of the through-hole 36*a* that faces the circumference of the side surface of the end portion of the shaft 5 supported by the first bearing portion 38 on the side of the motor portion so as to surround the circumference of the side surface.

Note that an oil seal 58 for preventing the oil from entering the side of the motor portion 10 is attached to the shaft 5 on the side of the motor portion 10 beyond the opening of the collection flow path 56 on the side of the other end.

The pump device 1 according to the modification example supplies a part of the oil supplied from the pressurized region Ap to the shaft 5 rotating via the supply port 53 if the shaft 5 rotates. Since the shaft 5 is rotatably supported by the first bearing portion 38 that serves as a sliding bearing, there is a clearance between the shaft 5 and the first bearing portion 38. Also, since the collection port 55 and the collection flow path 56 that are connected to the negative pressure region An of the pump rotor 31 are brought into a negative pressure state during the rotation of the shaft 5, the clearance is also brought into a negative pressure state. Therefore, the oil supplied from the supply port 53 to the shaft 5 passes through the clearance, flows through the collection flow path 56, and is then collected by the collection port 55. Then, the oil collected by the collection port 55 flows inside the accommodation portion 37 and moves to the side of the pressurized region Ap of the pump rotor 31.

Therefore, it is possible to supply the oil to the shaft 5 supported by the first bearing portion 38 during rotation of the shaft 5. Therefore, it is possible to reduce, by the oil, heat generation, abrasion, and the like due to contact between the shaft 5 and the first bearing portion 38. Also, since the first bearing portion 38 is a through-hole 36*a* and has a simple configuration, it is possible to further prevent costs for the pump device 1 from increasing.

[Another Modification Example of First Example Embodiment]

FIG. 7 is a sectional view of a pump device according to another modification example of the first example embodiment. Only differences from the aforementioned first example embodiment will be described for another modification example, the same reference numerals will be given to the same parts as those in the first example embodiment, and description thereof will be omitted.

As illustrated in FIG. 7, the accommodation portion 37 that accommodates the pump rotor 31 is provided on the other side (rear side) of the pump cover 40 in the axial direction. The accommodation portion 37 has an opening portion 37*a* at which an end portion on the other side in the axial direction is opened. The opening portion 37*a* is covered with an end surface of the pump body 36 on one side in the axial direction.

The pump body 36 has a through-hole 36*a* along the central axis J, the through-hole 36*a* on one side (front side) in the axial direction is opened in an end surface of the pump body 36 on one side in the axial direction, and the through-hole 36*a* on the other side (rear side) in the axial direction is opened in an end surface of the pump body 36 on the other side in the axial direction.

In this manner, similar advantages to those of the pump device 1 according to the aforementioned first example embodiment, that is, advantages that a heat, abrasion, and the like caused by contact between the shaft 5 and the second bearing portion 39 can be reduced by the oil can be achieved by providing the accommodation portion 37 that accommodates the pump rotor 31 at the pump cover 40. Also, since the second bearing portion 39 is a through-hole 40*a*2 and has a simple configuration, it is possible to prevent costs for the pump device 1 from increasing.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

The invention claimed is:

1. A pump device comprising:

a motor portion that includes a shaft rotating about a central axis extending in an axial direction; and a pump portion that is located on one side of the motor portion in the axial direction and that is driven by the motor portion via the shaft to eject oil, wherein the pump portion includes:

a pump rotor that rotates along with the shaft extending from the motor portion, and a pump housing that includes an accommodation portion that accommodates the pump rotor, the pump housing includes:

a pump body that includes a first bearing portion rotatably supporting the shaft, and a pump cover that covers the pump body on one side in the axial direction such that the accommodation portion is disposed between the pump cover and the pump body, the pump cover includes an inlet port into which the oil is suctioned and a through-hole which extends completely through the pump cover in the axial direction, the shaft extending into the through hole, the through-hole includes:

a flow path serving as an ejection port of the oil, a second bearing portion serving as a sliding bearing that rotatably supports the shaft, and a clearance between the second bearing portion and the shaft, the clearance serving as a feeding flow path in which a portion of the oil in the accommodation portion flows to a side of the flow path, and an end portion of the shaft on one side in the axial direction is disposed at the second bearing portion or inside the flow path.

2. The pump device according to claim 1, wherein the end portion of the shaft on the one side in the axial direction includes a corner portion that includes an inclined surface with a diameter that reduces toward the one side in the axial direction, an end surface of the shaft on the one side in the axial direction is a tip end surface with a smaller diameter than a diameter of the shaft, and an inner diameter of the through-hole is greater than the diameter of the end surface on the one side in the axial direction.

3. The pump device according to claim 2, wherein the inner diameter of the through-hole is greater than a diameter of an end of the inclined surface on another side in the axial direction.

4. The pump device according to claim 1, wherein the pump cover includes an ejection port that ejects the oil supplied from the pump rotor and an ejection flow path via which the ejection port and the flow path communicate, the flow path includes an annular flow path-side chamfered surface with a diameter that increases toward one side in the axial direction that is provided at a corner portion of the end portion of the flow path on another side in the axial direction and a tubular surface that is connected to the end of the flow path-side chamfered surface on one side in the axial direction and that extends on one side in the axial direction, and the ejection flow path is connected to one side in the axial direction beyond the end of the flow path-side chamfered surface on the another side in the axial direction.

5. The pump device according to claim 4, wherein an annular pump rotor-side chamfered surface with a diameter that reduces toward one side of the through-hole in the axial direction is provided at the corner portion of the opening portion of the through-hole on the accommodation portion side, and a depth of the pump rotor-side chamfered surface in the axial direction is smaller than a depth of the annular flow path-side chamfered surface in the axial direction.

6. The pump device according to claim 5, wherein the pump rotor is a positive displacement pump that includes an inner rotor attached to the shaft and an outer rotor surrounding an outside of the inner rotor in a radial direction and that ejects the oil by a volume inside the accommodation portion being enlarged and reduced through rotation of the inner rotor and the outer rotor.

7. The pump device according to claim 6, wherein the ejection port is located in a region in which the volume in the accommodation portion is reduced with the rotation of the inner rotor and the outer rotor.

8. The pump device according to claim 1, wherein the pump cover includes an ejection port that ejects the oil supplied from the pump rotor and an ejection flow path via which the ejection port and the flow path communicate, the flow path includes an annular flow path-side chamfered surface with a diameter that increases toward the one side in the axial direction that is provided at a corner portion of the end portion of the flow path on another side in the axial direction and a tubular surface that is connected to the end of the annular flow path-side chamfered surface on the one side in the axial direction and that extends on the one side in the axial direction, and the ejection flow path is connected to the tubular surface.

9. The pump device according to claim 8, wherein an annular pump rotor-side chamfered surface with a diameter that reduces toward one side of the through-hole in the axial direction is provided at the corner portion of the opening portion of the through-hole on the accommodation portion side, and a depth of the pump rotor-side chamfered surface in the axial direction is smaller than a depth of the annular flow path-side chamfered surface in the axial direction.

10. The pump device according to claim 9, wherein the pump rotor is a positive displacement pump that includes an inner rotor attached to the shaft and an outer rotor surrounding the outside of the inner rotor in a radial direction and that ejects the oil by a volume inside the accommodation portion being enlarged and reduced through rotation of the inner rotor and the outer rotor.

11. The pump device according to claim 10, wherein the ejection port is located in a region in which the volume in the accommodation portion is reduced with the rotation of the inner rotor and the outer rotor.

12. The pump device according to claim 1, wherein a length of a bearing surface of the second bearing portion, which supports the shaft, in the axial direction is the same as a length of a bearing surface of the first bearing portion, which supports the shaft, in the axial direction.

13. The pump device according to claim 12, wherein the length of the bearing surface of each of the first bearing portion and the second bearing portion in the axial direction is longer than a length of the pump rotor in the axial direction.

* * * * *